US008012048B1

(12) United States Patent
Montalvo

(10) Patent No.: US 8,012,048 B1
(45) Date of Patent: Sep. 6, 2011

(54) TENNIS GRIP REFERENCE AID

(76) Inventor: Carlos Montalvo, Boca Raton, FL (US)

( * ) Notice: Subject to any disclaimer, the term of this patent is extended or adjusted under 35 U.S.C. 154(b) by 0 days.

(21) Appl. No.: 12/708,693

(22) Filed: Feb. 19, 2010

(51) Int. Cl.
*A63B 69/38* (2006.01)

(52) U.S. Cl. ..... 473/459; 473/553

(58) Field of Classification Search ..... 473/553, 473/524, 459, 461, 463, 549; 434/247
See application file for complete search history.

(56) References Cited

U.S. PATENT DOCUMENTS

| | | | | |
|---|---|---|---|---|
| 1,917,236 | A * | 7/1933 | Bloomstrand | 434/247 |
| 4,006,896 | A * | 2/1977 | Soldavini | 473/551 |
| 4,072,311 | A | 2/1978 | Bertucci | |
| 4,209,169 | A | 6/1980 | Roberts | |
| 4,664,381 | A | 5/1987 | Aaron | |
| 4,796,889 | A * | 1/1989 | Muraour | 473/549 |
| 4,961,572 | A | 10/1990 | Badillo et al. | |
| D330,060 | S | 10/1992 | Fagen | |
| 5,163,685 | A | 11/1992 | Rhodes | |
| 5,671,926 | A | 9/1997 | Hagey | |
| 5,924,941 | A | 7/1999 | Hagey | |
| 5,931,749 | A | 8/1999 | Hagey | |
| 6,299,557 | B1 | 10/2001 | Mueller | |
| 6,916,260 | B1 | 7/2005 | Poteet | |
| 7,160,216 | B2 | 1/2007 | Failla Colonnello Seppi et al. | |
| 7,276,000 | B1 | 10/2007 | Baker | |
| 7,445,570 | B2 | 11/2008 | Rodgers et al. | |
| 7,758,455 | B2 * | 7/2010 | Thomas | 473/551 |
| 2005/0266942 | A1 | 12/2005 | Failla Colonnello Seppi et al. | |
| 2008/0032832 | A1 | 2/2008 | Thomas | |
| 2009/0011875 | A1 * | 1/2009 | Drake et al. | 473/551 |

* cited by examiner

*Primary Examiner* — Raleigh W. Chiu
(74) *Attorney, Agent, or Firm* — Gold & Rizvi, P.A.; Glenn E. Gold; H. John Rizvi

(57) ABSTRACT

An aid for teaching players specific proper tennis grips is provided in two form factors. The aid can be provided in a wrap or a band form factor. The aid comprises a reference for each of the following grips: Continental, Eastern, Semi-Western, and Western. The references are spatially located on the aid, such that when installed onto a neck of a tennis racket, each reference aligns with the "V" formed between player's thumb and forefinger when holding the racket with the respective grip. The references can be color coded, provided in differing fonts, include unique graphical representations, and the like.

8 Claims, 6 Drawing Sheets

TENNIS GRIP REFERENCE AID

FIELD OF THE INVENTION

The present disclosure generally relates to an apparatus and method for providing a tennis player with a tennis grip reference. More particularly, a tennis grip aid is provided in a wrap or band form factor, securable directly to a racket neck, wherein the aid includes a reference for each of the following grips: Continental, Eastern, Semi-Western, and Western.

BACKGROUND OF THE INVENTION

Tennis is a very popular sport played by individuals throughout the world. In order to become a proficient tennis player, it is necessary to learn a variety of conventional tennis racquet grip types.

The type of tennis racket grip used directly affects and controls the angle of the racket during the player's stroke which, in turn, controls the return direction and spin of the tennis ball. The tennis racquet is essentially an extension of the hitting arm, where both the racket and arm work as one unit. This proper grip technique contributes to optimize the results of the player's swing.

The term "grip" is used define both the covered handle portion of the tennis racket, and the manner in which the player wraps one or both of hands about the racket handle to hold onto the racquet during play. How the player holds the racquet determines the angle of the racquet face, thus defining how the strings of the racquet contact the tennis ball during a swing or stroke. During a forehand swing, the player holds the tennis racquet in one hand and swings the racquet orienting the palm of the hand towards the ball or facing the player's opponent. A backhand stroke is generally opposite to the forehand; more specifically, the player swings the racket with the back of the player's hand facing the ball and opponent.

Conventional grips include the following: (1) Continental grip; (2) Eastern Grip; (3) Semi-Western Grip; and (4) Western grip. The Continental grip is primarily used for serving, volleying, hitting overheads, hitting slices and other defensive shots. The Eastern grip is a one-handed grip that can be used for a kick serve or to hit a one-handed backhand. The Semi-Western and Western grips allow the player to hit the ball with topspin during a forehand, which results in a more controlled and safer shot.

Many grip devices have been created to try to teach novice tennis players different grip types. Many such devices incorporate a grip molded to force a tennis player's fingers into a particular grip configuration. While this is effective to show a player how to grip the racquet, such preformed grips are not useable during actual play. Other aids are either bulky or tend to throw off the racquet balance. That is, tennis racquets are constructed to have a particular weight distribution, and such devices interfere with that weight distribution.

Accordingly, there is a need for a simple, inexpensive, easy-to-manufacture tennis grip reference aid that can be used by novice tennis players learning different grip types and experienced tennis players requiring a quick grip reference that can be used during actual play. Preferably, the grip aid should not detract from the look or feel of the racquet during use, and is adapted to be easily transferred from racquet to racquet.

SUMMARY OF THE INVENTION

The basic inventive concept provides a tennis grip reference aid designed to be wrapped about a neck of a tennis racquet to aid in teaching a player a series of tennis grips, or to provide a quick visual reference to a player during actual match play.

A first aspect of the present invention provides a tennis teaching aid comprising:

a wrap material having an exterior surface and a contact surface; and a series of indicators spatially arranged about the exterior surface, wherein each indicator is uniquely associated with a recognized tennis grip.

A second aspect of the present invention further defines the recognized tennis grips as being selected from a group consisting of: Continental grip, Eastern grip, Semi-Western grip, and Western grip.

In another aspect, the indicators are text indicia selected from a group consisting of: Continental, Eastern, Semi-Western, and Western.

In yet another aspect, at least one of the grip indicators is uniquely identified by a non-textural marking to ensure the specific respective grip stands out from the others.

In yet another aspect, the various indicators are color-coded.

In yet another aspect, the wrap material is provided as a planar material defined by a perimeter having a first closure edge, a second closure edge and two side edges spanning therebetween. A first fastener portion is provided adjacent the first closure edge and a mating fastener portion is provide adjacent the second closure edge, wherein the first fastener portion mates with the second fastener portion.

In yet another aspect, the planar material is inelastic, wherein the adjustments are compensated by the mating fastener interface.

In yet another aspect, the planar material is provided as a planar material defined by a perimeter having a first attachment edge, a second attachment edge and two side edges spanning therebetween. The first attachment edge is bound to the second attachment edge forming a tubular shaped structure.

In yet another aspect, the planar material is elastic.

In another aspect, a method for providing a tennis player with reference locations for specific known tennis grips, comprises the steps of:

providing a material wrap having an exterior surface and an interior contact surface, a series of indicators spatially arranged about the exterior surface, wherein each indicator is uniquely associated with a recognized tennis grip;

applying the wrap about a neck portion of a tennis racket;

aligning at least one grip reference to the associated location of the referenced grip style;

determining a desired grip, wherein the desired grip is associated with a grip style indicator; and gripping the tennis racket with the player's hand in accordance with the desired grip and aligning a "V" between the players gripping thumb and forefinger with the respective grip style indicator.

In another aspect, the method further comprises the steps of:

determining a second desired grip while continuing play of a tennis game;

adjusting the grip type from the first desired grip to the second desired grip; and gripping the tennis racket in accordance with the second desired grip and aligning a "V" between the players gripping thumb and forefinger with the respective second grip style indicator.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
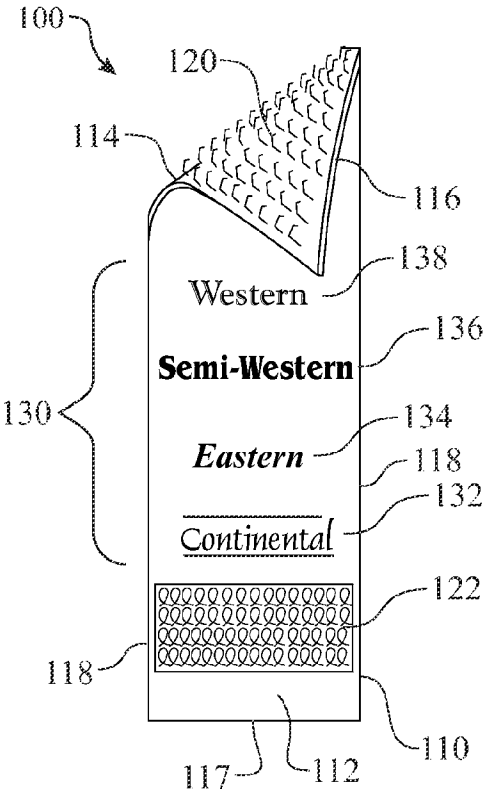
FIG. 1 presents a planar view of a first exemplary embodiment of a tennis teaching aid, the first embodiment presenting a wrap form factor.

In a first exemplary implementation of the present invention, a grip identification wrap 100 is provided, as best illustrated in FIG. 1. The grip identification wrap 100 is fabricated of a panel of a wrap material 110 having a wrap exterior surface 112 and a wrap contact surface 114. The wrap panel 110 is defined by a first end edge 116, a second end edge 117 and a pair of side edges 118. A hook material 120 is disposed upon the wrap material 110 proximate the first end edge 116. A loop material 122 is disposed upon the wrap material 110 proximate the second end edge 117. The hook material 120 mates with the loop material 122 to join the first end edge 116 with the second end edge 117 to form the wrap material panel 110 into a tubular configuration. A series of grip indicators 130 are provided on the wrap exterior surface 112 of the grip identification wrap 100. The grip indicators 130 can include an indicia representative of any or all of a group of tennis grip styles, preferably including a Continental grip indicator, an Eastern grip indicator, a Semi-Western grip indicator, and a Western grip indicator. In the exemplary illustration, a Continental grip reference 132 is provided respective to the Continental grip, an Eastern grip reference indicator 134 is provided respective to the Eastern grip, a Semi-Western grip reference indicator 136 is provided respective to the Semi-Western grip, and a Western grip reference indicator 138 is provided respective to the Western grip. The preferred reference is text. The text or indicia can be color-coded. The text can be applied via embroidery, printing, embossing, appliqué, and the like. It is understood other reference indicia can be provided such as graphical representations, colors, and the like. Further, at least one of the grip indicators 130 can be identified as a stand out by the addition of feature, such as lines as shown with reference to the Continental indicator 132, to provide the player with a quick visual base reference point.

Figure 2:
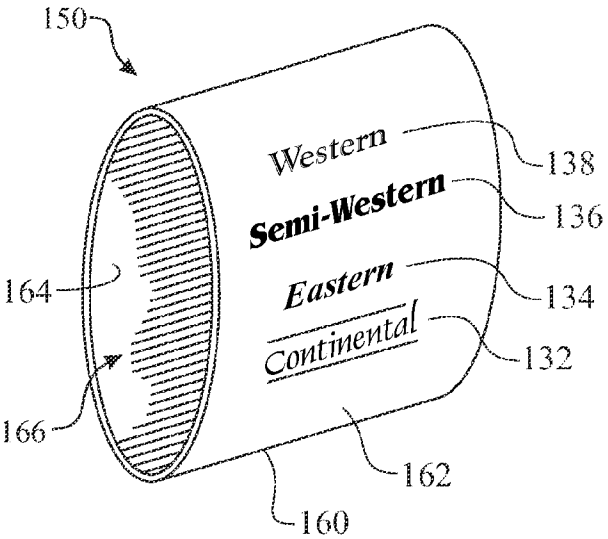
FIG. 2 presents an isometric view of a second exemplary embodiment of a tennis teaching aid, the second embodiment presenting a band form factor.

In a second exemplary implementation, a grip identification band 150 is provided, as best illustrated in FIG. 2. The grip identification band 150 is fabricated of a piece of wrap material 110 having a wrap exterior surface 112 and an interior wrap contact surface 114. The band material 160 is provided in a contiguous tubular form factor. The band material 160 can be constructed from a tubular woven material, or from a planar woven material (similar to the wrap material 110) having the two narrow ends joined to form the tubular shape. The band material 160 is preferably elastic. The band includes a band exterior surface 162 and a band contact surface 164. A band center 166 is formed within an interior of the tubular configuration of the grip identification band 150. The series of grip indicators 130 are applied to the band exterior surface 162 as described respective to the grip identification wrap 100.

Figure 3:
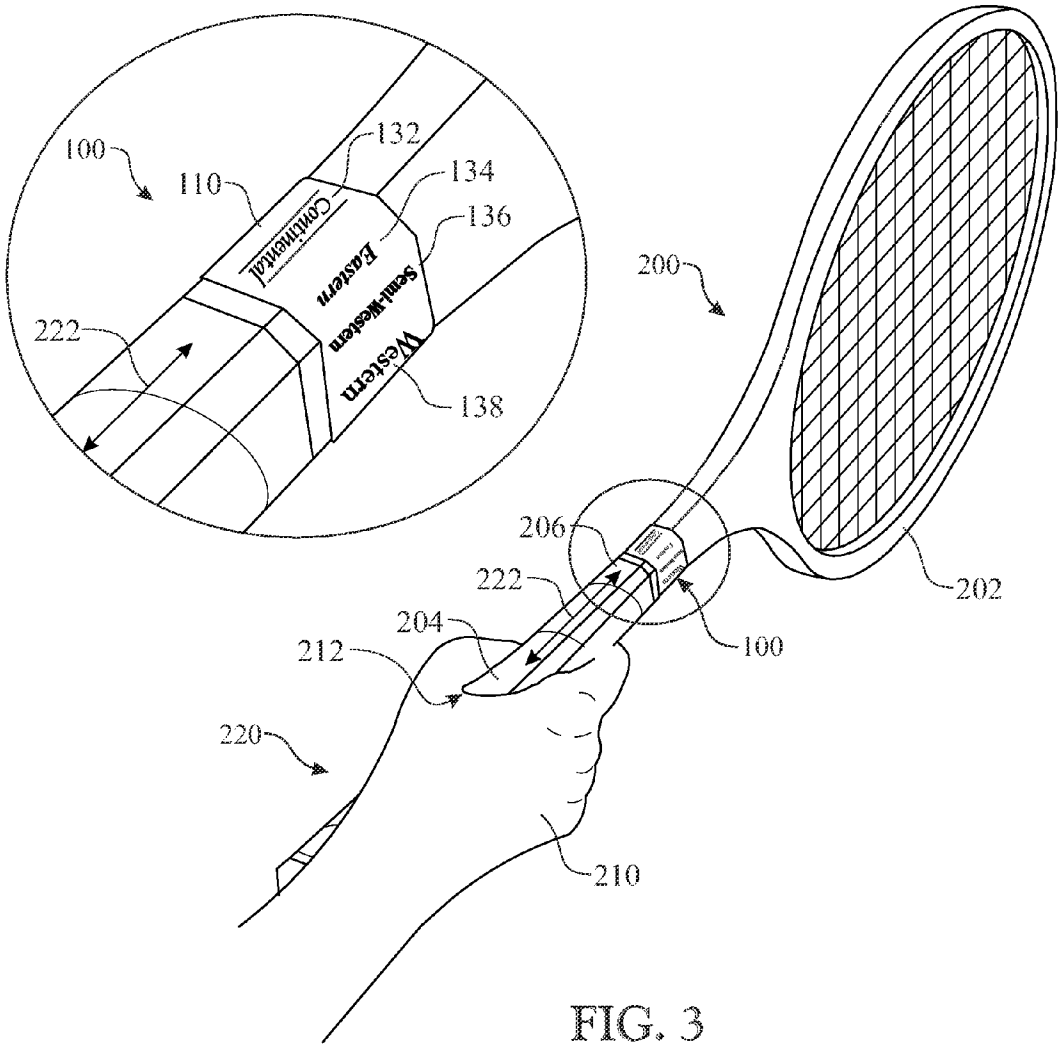
FIG. 3 presents an exemplary isometric illustration and enlarged detailed view demonstrating a Continental grip.

The Player installs the grip identification wrap 100 onto a tennis racket neck 206 section of a tennis racket 200, proximate a base region of a tennis racket head 202, as illustrated in FIGS. 3-6. The grip identification wrap 100 is placed above the tennis racket handgrip 204 of the tennis racket 200 by wrapping and securing the hook material 120 to the loop material 122. Alternately, when using a grip identification band 150, the player stretches the grip identification band 150 and slides the grip identification band 150 over a tennis racket handgrip 204 onto the tennis racket neck 206. The player would hold the tennis racket 200 in a "handshake position" as illustrated in FIG. 3. The grip identification wrap 100 is then aligned such that the continental grip reference 132 appears directly above the player's thumb to forefinger "V" 212 formed by a player's hand 210 of the player as illustrated in FIG. 3.

Examples of the various grips as referenced by the grip identification wrap 100 are illustrated in FIGS. 3-6. The Continental grip is presented in FIG. 3. The Easter grip is presented in FIG. 4. The Semi-Western grip is presented in FIG. 5. The Western grip is presented in FIG. 6.

The player aligns the player's thumb-to-forefinger "V" 212 of their player's hand 210 with the continental grip reference 132, as indicated by a Continental grip alignment 222, to achieve a Continental grip 220 as illustrated in FIG. 3. The Continental Grip 220, also called the Chopper grip, is obtained when placing the hand such that the base knuckle of the index finger is right on the 2nd bevel. It is naturally obtained when holding the racket as if it were an axe, for chopping. The Continental grip 220 is suitable for a variety of shots and therefore is often taught to novices and beginners, so that they should not bother changing grips while learning the basics of the game. The Continental grip 220 does not allow for much topspin during groundstrokes. As modern day tennis, particularly on clay courts, has shown an evolution towards topspin, the Continental grip 220 has gone out of fashion with professional players for hitting groundstrokes. However, it is still the preferred grip for serving and volleying. The remaining grips strike a balance between high spin capacity on one hand, and variety and control on the other hand. Due to the primary application of the Continental grip 220, the grip identification wrap 100 includes a line located above and below the indicia of the continental grip reference 132 to help the player clearly identify this marking.

Figure 4:
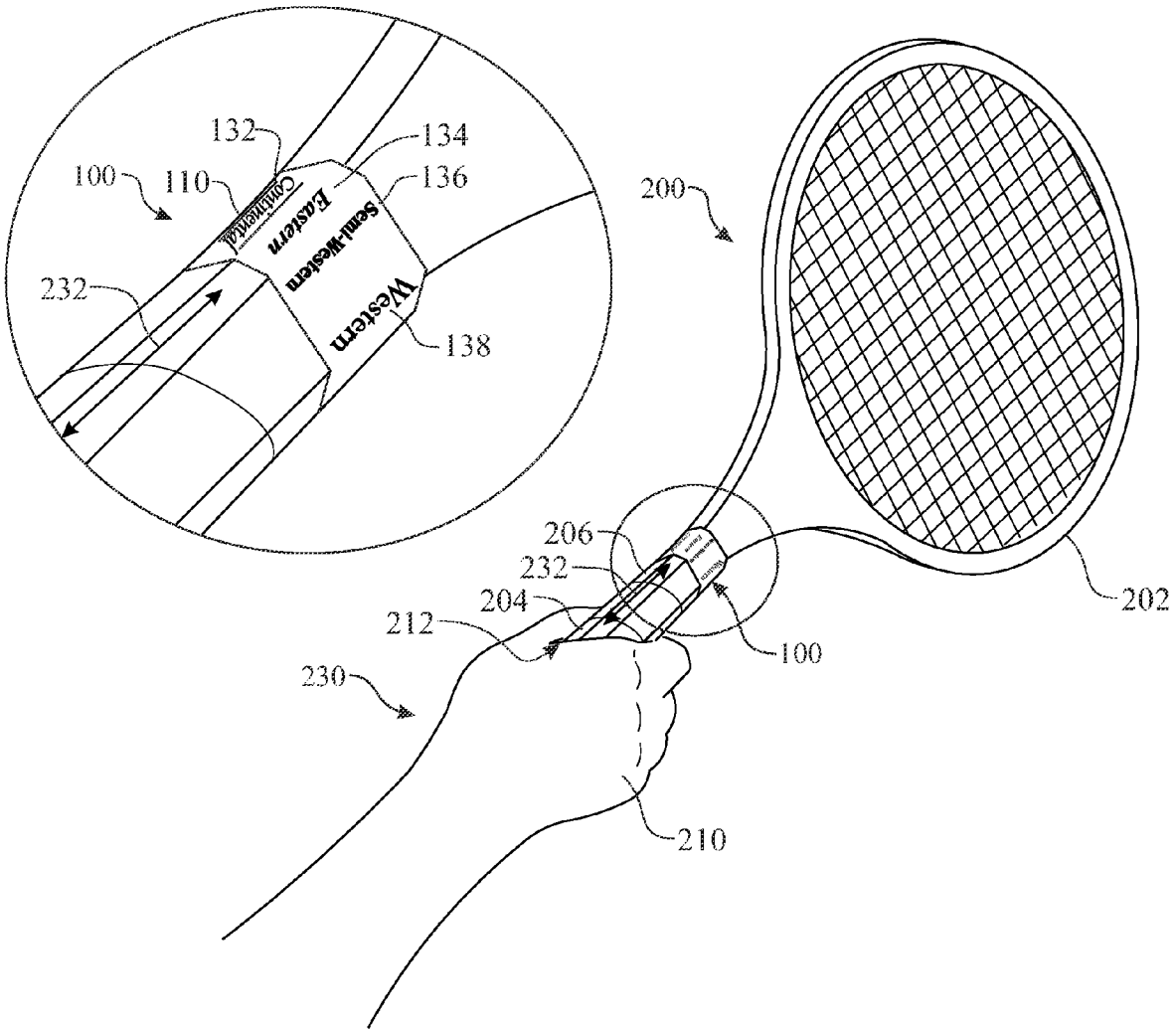
FIG. 4 presents an exemplary isometric illustration and enlarged detailed view demonstrating a Eastern grip.

The player aligns the player's thumb to forefinger "V" 212 of their player's hand 210 with the eastern grip reference 134 as indicated by a Eastern grip alignment 232 to achieve an Eastern grip 230 as illustrated in FIG. 4. The Eastern Forehand Grip 230 is achieved when placing the hand such that the base knuckle of the index finger is on the 3rd bevel. It is naturally obtained when picking up a racquet lying on the ground, or "shaking hands" with a perpendicularly held racquet. The Eastern Forehand grip 230 allows for more topspin on the forehand while keeping control, because the shift along the handle is only 45 degrees (from the basic Continental grip 220).

Figure 5:
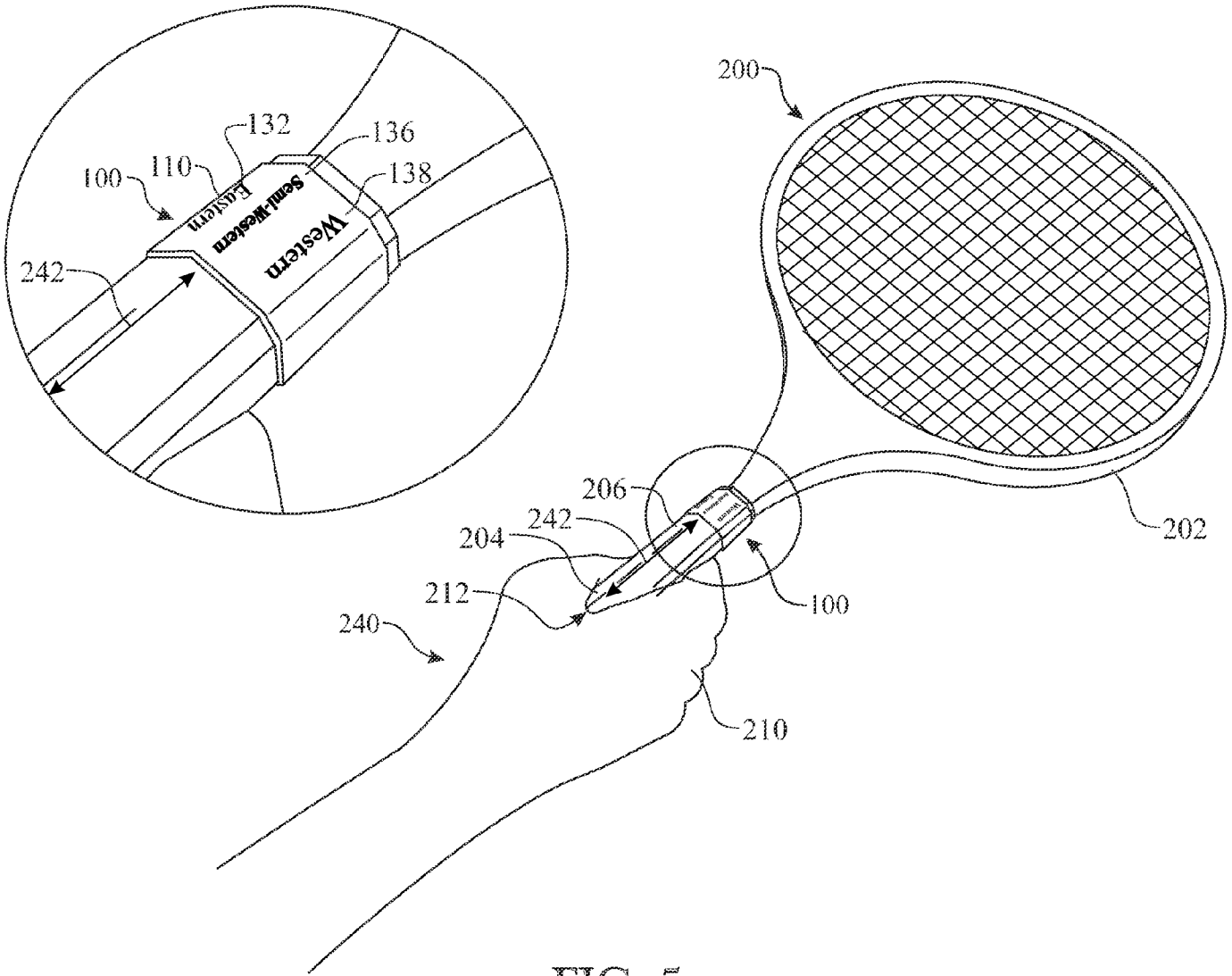
FIG. 5 presents an exemplary isometric illustration and enlarged detailed view demonstrating a Semi-Western grip.

The player aligns the player's thumb to forefinger "V" 212 of their player's hand 210 with the Semi-Western grip reference 136 as indicated by a Semi-Western grip alignment 242 to achieve a Semi-Western grip 240, as illustrated in FIG. 5. The Player should be holding the grip about a quarter turn further clockwise approaching the next bevel from the Eastern forehand grip 230. The Semi-Western grip 240 is ideal for generating both tremendous power and topspin.

Figure 6:
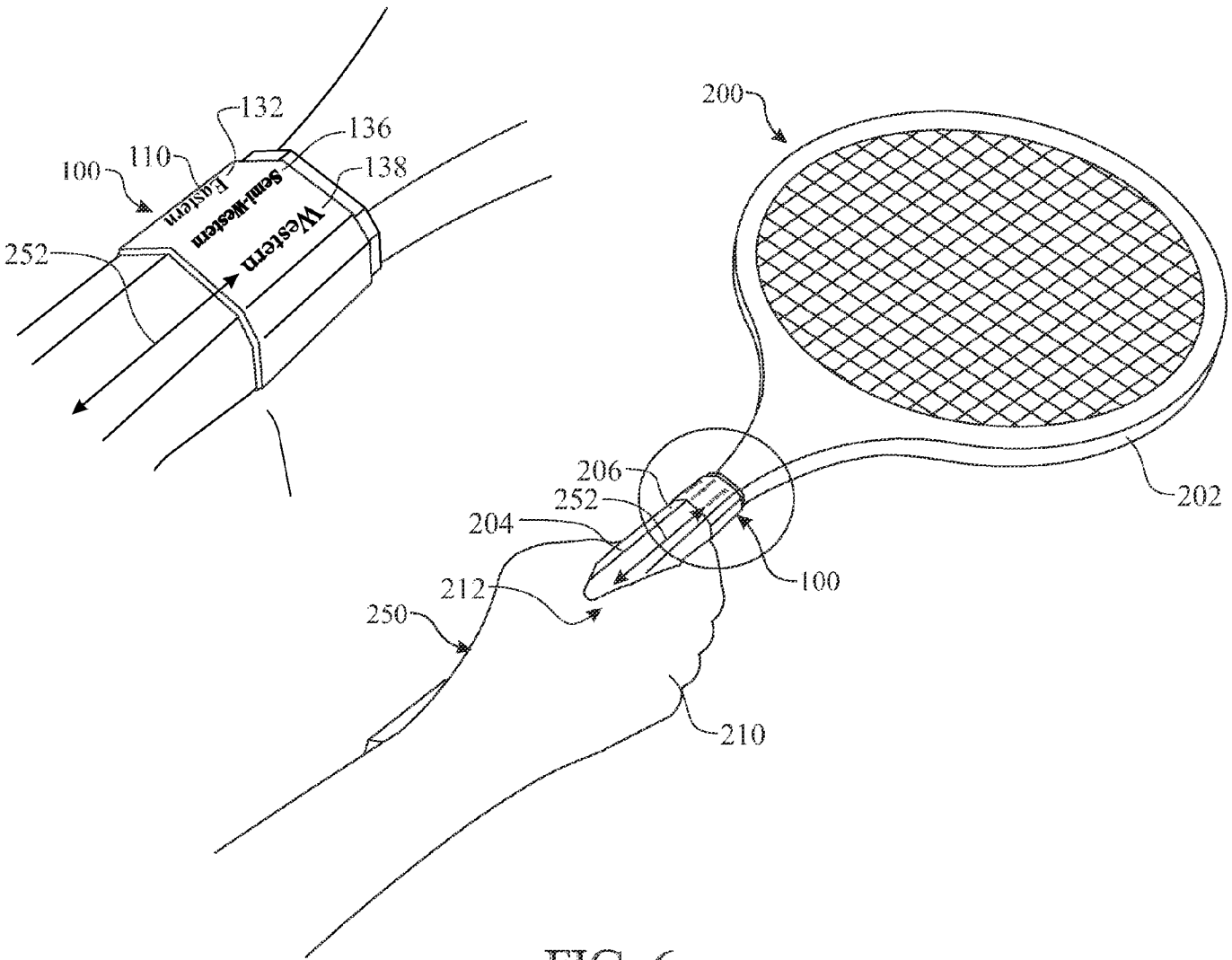
FIG. 6 presents an exemplary isometric illustration and enlarged detailed view demonstrating a Western grip.

The player aligns the player's thumb to forefinger "V" 212 of the hand 210 with the western grip reference 138, as indicated by a Western grip alignment 252, to achieve a Western grip 250, as illustrated in FIG. 6. The Western Grip 250 is achieved by placing the hand such that the base knuckle of the index finger is on the 5th bevel. Compared to the Continental grip 220, the blade 202 has rotated 135 degrees. This forces the wrist into an uncomfortable twist, but allows for the greatest possible spin. This is basically equivalent to the Eastern Backhand grip 230, except that the same face of the racquet is used to strike the ball.

Figure 7:
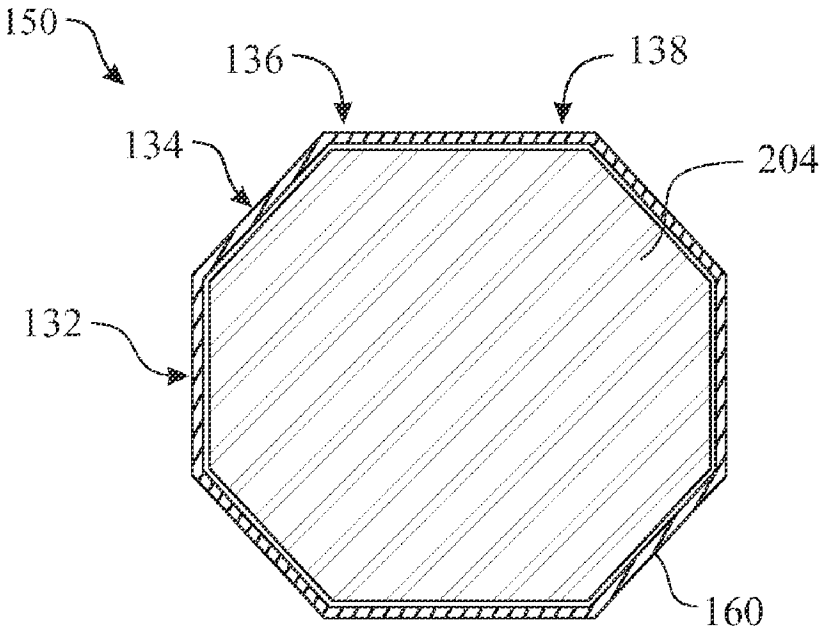
FIG. 7 presents a sectional end view of a neck portion of a tennis racket illustrating the reference locations for each grip.

A sectional end view taken along the tennis racket handgrip 204 is presented in FIG. 7 to further illustrate the reference locations for the Continental grip reference 132, Eastern grip reference 134, Semi-Western grip reference 136 and Western grip reference 138. The resilient band material 160 is temporarily stretched, allowing the Player to slip the grip identification band 150 over the tennis racket handgrip 204 and up towards the tennis racket neck 206. Alternately, the player would wrap the wrap material 110 about the tennis racket neck 206 to achieve the same installed functionality.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A tennis teaching aid, the aid comprising:

a wrap material being a sheet of material having a perimeter defined by a first edge, a second edge, and a pair of side edges spanning between respective ends of each of the first and second edges, the wrap material further having an exterior surface and a contact surface and being of a length to securely fasten about a neck of a tennis racket;

a series of indicators spatially arranged about the exterior surface, wherein each indicator is uniquely associated and positioned respective to a recognized tennis grip;

a first releaseably engaging interface disposed upon to the wrap material proximate the first edge; and a mating releaseably engaging interface disposed upon to the wrap material proximate the second edge, wherein the first releaseably engaging interface and mating releaseably engaging interface releasably engage with each other to assemble the wrap material into a tubular configuration.

2. A tennis teaching aid as recited in claim 1, wherein the series of indicators are associated with at least two recognized tennis grips, the grips being selected from a grips group consisting of: Continental grip, Eastern grip, Semi-Western grip, and Western grip.

3. A tennis teaching aid as recited in claim 2, wherein the series of indicators are presented in a text format.

4. A tennis teaching aid as recited in claim 1, wherein the series of indicators comprising an indicator for each of the following grips: Continental grip, Eastern grip, Semi-Western grip, and Western grip.

5. A tennis teaching aid as recited in claim 4, wherein the series of indicators are presented in a text format.

6. A tennis teaching aid as recited in claim 4, wherein one specific indicator selected from the series of indicators further includes a unique identifying marking to quickly identify to the one specific indicator from the other indicators.

7. A tennis teaching aid as recited in claim 4, wherein the series of indicators are color-coded.

8. A tennis teaching aid as recited in claim 1, wherein the series of indicators are color-coded.

* * * * *